US009320939B1

(12) United States Patent
Hyslop et al.

(10) Patent No.: US 9,320,939 B1
(45) Date of Patent: Apr. 26, 2016

(54) MODULAR MIRROR BOX THERAPY SYSTEM FOR THE LOWER EXTREMITY

(71) Applicants: Amanda Mary Hyslop, Raleigh, NC (US); Dustin Cram, Portland, OR (US)

(72) Inventors: Amanda Mary Hyslop, Raleigh, NC (US); Dustin Cram, Portland, OR (US)

(73) Assignee: Amanda Hyslop, Durham, NC (US)

( * ) Notice: Subject to any disclaimer, the term of this patent is extended or adjusted under 35 U.S.C. 154(b) by 70 days.

(21) Appl. No.: 14/527,549

(22) Filed: Oct. 29, 2014

(51) Int. Cl.

| | |
|---|---|
| ***G09B 19/00*** | (2006.01) |
| ***A63B 23/04*** | (2006.01) |
| ***A61B 5/00*** | (2006.01) |
| *A61F 2/50* | (2006.01) |

(52) U.S. Cl.
CPC ..... *A63B 23/04* (2013.01); *A61B 5/486* (2013.01); *A61F 2002/5064* (2013.01)

(58) Field of Classification Search
USPC ..... 434/258, 260, 262, 365; 472/63; 482/44, 79, 148; 600/544
See application file for complete search history.

(56) References Cited

U.S. PATENT DOCUMENTS

| | | | | |
|---|---|---|---|---|
| 7,756,584 | B2 * | 7/2010 | Sheffield | A61N 1/0531 600/544 |
| 8,568,231 | B2 * | 10/2013 | Solanki | A61B 5/1114 463/30 |
| 8,725,264 | B2 * | 5/2014 | Soler Fernandez | A61N 1/36021 607/45 |
| 8,938,289 | B2 * | 1/2015 | Einav | A61B 5/0484 600/544 |
| 8,953,909 | B2 * | 2/2015 | Guckenberger | G06T 11/00 382/305 |
| 2009/0237611 | A1 * | 9/2009 | Walsh | G02C 7/14 351/158 |

OTHER PUBLICATIONS

V. S. Ramachandran1 and Eric L. Altschuler, "The use of visual feedback, in particular mirror visual feedback, in restoring brain function", Brain 2009: 132; 1693-1710 [retrieved online Feb. 29, 2016].*

McCabe, "Mirror Visual Feedback Therapy: A Practical Approach", Journnal of Hand Therapy Apr.-Jun. 2011, pp. 170-179 [retrieved online Feb. 29, 2016].*

* cited by examiner

*Primary Examiner* — Kurt Fernstrom
(74) *Attorney, Agent, or Firm* — Baumgartner Patent Law; Marc Baumgartner

(57) ABSTRACT

The disclosed systems and methods provide for a mirror box therapy system as a therapeutic tool for treating patients having one healthy and one unhealthy limb. This can include stroke patients or those whom otherwise have full or partial paralysis. Also suitable patients include amputees with phantom limb pain or those with intact legs whom have unilateral chronic lower extremity pain. The system is designed to be used with patients in the short sit position or long sit position and can be alternated between each position including switching between left side and right side limb treatment. The methods of treatment with the disclosed system are designed to provide for positive visual feedback and induce brain plasticity with the improvement of neural connections leading to pain and/or motor rehabilitation of the impaired limb.

20 Claims, 8 Drawing Sheets

MODULAR MIRROR BOX THERAPY SYSTEM FOR THE LOWER EXTREMITY

FIELD OF THE INVENTION

The present disclosure pertains to systems and methods for rehabilitating a patient diagnosed or experiencing neurologic chronic pain, phantom limb pain, or a lack of motor skills. More specifically, the teachings herein are directed to rehabilitating phantom limb pain or a lack of motor skills observed with amputees and stroke patients.

BACKGROUND OF THE DISCLOSURE

Mirror visual feedback therapy was initially used with unilateral upper extremity amputees for phantom limb pain and has progressed to treat patients with other pain syndromes. Mirror therapy has also been used to treat phantom pain in the lower extremity and, more recently, to promote motor recovery in the leg of stroke patients. In general, mirror therapy treatment methods consist of placing an impaired limb inside of a box with a mirror attached to the side while the healthy limb is positioned adjacent to the mirror outside the box. In some treatment methods, a physical therapist then directs the patient in guided movements and mental imagery, while visualizing the healthy limb reflection. This noninvasive process utilizes visual feedback to promote brain plasticity to afford a reduction in disability and/or pain.

Up until now, prior mirror boxes could not be configured to easily accommodate patients in both a short sit (elevated sitting position) and a long sit position, including treatment of both right and left unhealthy limbs. Furthermore, prior mirror boxes were not configured to prevent a patient from "cheating" by looking into the mirror box to view their unhealthy limb, as opposed to the reflection of their healthy limb through the external mirror.

SUMMARY OF THE INVENTION

In one embodiment, the disclosed a mirror box, comprising: a) three interconnected panels defining a C-shaped internal space configured to hold a patient's unhealthy limb, comprising: i) a rectangular mirror panel having first and second long and short sides; wherein the mirror faces away from the internal space; ii) an opaque long rectangular panel, having first and second long and short sides, wherein the first long side is perpendicularly hinged to the first long side of a mirror frame such that the long rectangular panel can fold toward the mirror panel to be substantially parallel with it; and iii) a square or rectangular sliding panel, comprising a sliding side that is 25-75% less than a length of the first and second long sides of the long rectangular panel and is perpendicularly hinged to and configured to slide along the second long side of the mirror frame; such that the sliding panel can fold toward the mirror panel to be substantially parallel with it; and b) an opaque flap that can be releasably attached to the mirror box to block the patient from viewing their unhealthy limb when positioned within the internal space of the mirror box.

In another embodiment, disclosed herein is a method of treatment with the use of the mirror box, comprising: a) identifying a patient with one unhealthy limb and a healthy limb; b) providing the mirror box of claim 1 to the patient; c) positioning patient's unhealthy limb into the internal space of the mirror box and their healthy limb outside the mirror box adjacent to the mirror such that the patient can view the reflection of their healthy limb; d) attaching the flap on the mirror box to prevent the patient from viewing their unhealthy limb within the internal space; and e) providing at least one exercise to the patient involving the movement of their healthy limb.

DETAILED DESCRIPTION OF THE EMBODIMENTS

Figure 1:
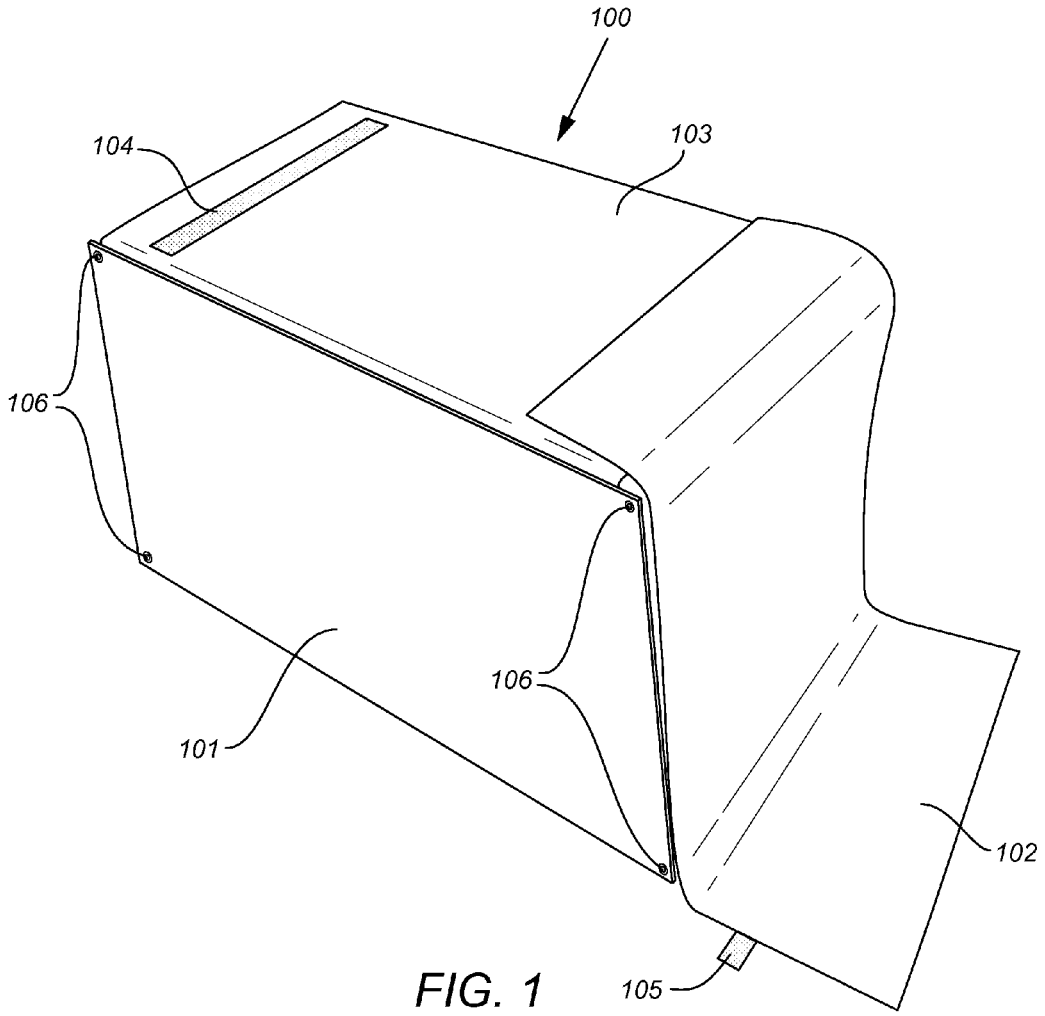
FIG. 1 is an illustration of a side view of the mirror box 100 assembled with the flap 102. In this orientation, the mirror box 100 can be used by a patient in a long sit position.

The following is a detailed description of certain specific embodiments of the methods disclosed herein. In this description, reference is made to the drawings.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items. As used herein, the term "comprising" means including elements or steps that are identified following that term, but any such elements or steps are not exhaustive, and an embodiment can include other elements or steps.

INTRODUCTION

In one aspect, disclosed herein is A mirror box, comprising:

a) three interconnected panels defining a C-shaped internal space configured to hold a patient's unhealthy limb, comprising:
   i. a rectangular mirror panel having first and second long and short sides; wherein the mirror faces away from the internal space;
   ii. an opaque long rectangular panel, having first and second long and short sides, wherein the first long side is perpendicularly hinged to the first long side of a mirror frame such that the long rectangular panel can fold toward the mirror panel to be substantially parallel with it; and
   iii. a square or rectangular sliding panel, comprising a sliding side that is 25-75% less than a length of the first and second long sides of the long rectangular panel and is perpendicularly hinged to and configured to slide along the second long side of the mirror frame; such that the sliding panel can fold toward the mirror panel to be substantially parallel with it; and b) an opaque flap that can be releasably attached to the mirror box to block the patient from viewing their unhealthy limb when positioned within the internal space of the mirror box.

FIGS. 1-8 illustrate different views of the mirror box, which may be used for treating a patient with partial or full paralysis and/or chronic pain or phantom limb pain in a single limb. The mirror box 100 affords a boxed "C-shape" comprising a strong frame fabricated from metal (i.e., steel, aluminum, titanium, etc.), plastic, carbon fiber or combinations thereof. In some embodiments, mirror is a reflective product, such as a glass mirror, acrylic mirror, or otherwise suitable material, attached to the middle of the rectangular mirror panel frame.

In some embodiments, an acrylic mirror 101 may be selected for its lightweight, shatterproof, and scratch resistant properties, and attached to the frame 108 and 112 through use of screws and washers 106 to the frame 108 and 112. However, another adequately reflective surface could be used in place of the acrylic mirror and any suitable method of attaching the reflective surface to the frame such as glue or other means could be done and fabricated with adequate space for the sliding side 107 to shuttle along the longer side 112 of the mirror unit frame. The back of the acrylic mirror may be painted with a liquid plastic material 111 to prevent damage to the mirror by preventing scratches to the back of the mirror and to provide a sanitizable surface.

In some embodiments, the mirror box is designed for stroke patients experiencing limb paralysis and lower extremity amputees. In its design, the mirror box is fabricated from lightweight and structural frame rails 108 and 112 fabricated from metal (i.e., steel, aluminum, titanium, etc.) plastic, or combinations thereof or other suitable material and connected at joints 110 through a structural weld or a metal, plastic or a sleeved 90 degree connector.

The fabricated frames have two sides depicted as an inner side and an outer side intended to provide a box with an open portion referred to as the working end. In some embodiments, the mirror box comprises a working end that comprises an open end of the mirror box with the mirror facing outwardly left or outwardly right and an outer surface of the long rectangular panel facing forward for the patient in a short sit position with a limb positioned inside the mirror box and the flap connected and draped over the same limb, thereby blocking the patient's line of sight to the same limb from the working end. In some embodiments, the mirror box comprises a working end that comprises an open end of the mirror box with the mirror facing outwardly left or outwardly right and an outer surface of the long rectangular panel facing upward for the patient in a long sit position with a limb positioned inside the mirror box and the flap connected and draped over the same limb, thereby blocking the patient's line of sight to the same limb from the working end.

There is the smaller sliding side 107 and a larger of the opposite long rectangular panel 103. Square or rectangular sliding panel 107 was designed so that when the mirror box is used in the short sit position (see FIGS. 3, 4, and 5), the bottom part of the client's thigh will not hit the top edge of sliding side 107. In one embodiment, square or rectangular sliding panel 107 may be designed to loosely connect to the frame of the rectangular mirror panel by employing a metal frame tubular frame as the sliding end 113 that has a slightly larger diameter than the metal frame of 112, or any suitable mechanism to allow the square or rectangular sliding panel 107 to shuttle from one end of the frame to the other in order to switch to left and right impaired limbs. Moreover, the mirror box therapy system may be rotated 180 degrees about its axis when in the short sit position depicted with FIGS. 3, 4, and 5, and accommodate a patient who has an impaired opposite leg (i.e., L/R).

In some embodiments, the mirror box comprises a working end that comprises an open end of the mirror box with the mirror facing outwardly left or outwardly right and an outer surface of the long rectangular panel facing forward for the patient in a short sit position with a limb positioned inside the mirror box and the flap connected and draped over the same limb, thereby blocking the patient's line of sight to the same limb from the working end. In some embodiments, the mirror box comprises a working end that comprises an open end of the mirror box with the mirror facing outwardly left or outwardly right and an outer surface of the long rectangular panel facing upward for the patient in a long sit position with a limb positioned inside the mirror box and the flap connected and draped over the same limb, thereby blocking the patient's line of sight to the same limb from the working end.

In some embodiments, the mirror box further comprises a left mirror box formed when the sliding side is positioned with the support arm connected to a first non-sliding side and a first short side of the long rectangular panel, wherein the left mirror box can independently accommodate the patient in a long sit position with an outer surface of the long rectangular panel facing up or a short sit position with an outer surface of the long rectangular panel facing forward by rotating the mirror box about its axis. In some embodiments, the mirror box further comprises a right mirror box formed when the sliding side is positioned with the support arm connected to a second non-sliding side and a second short side of the long rectangular panel; and wherein the right mirror box and the left mirror box can independently accommodate the patient in a long sit position with an outer surface of the long rectangular panel facing up or a short sit position with an outer surface of the long rectangular panel facing forward by rotating the mirror box about its axis.

Figure 8:
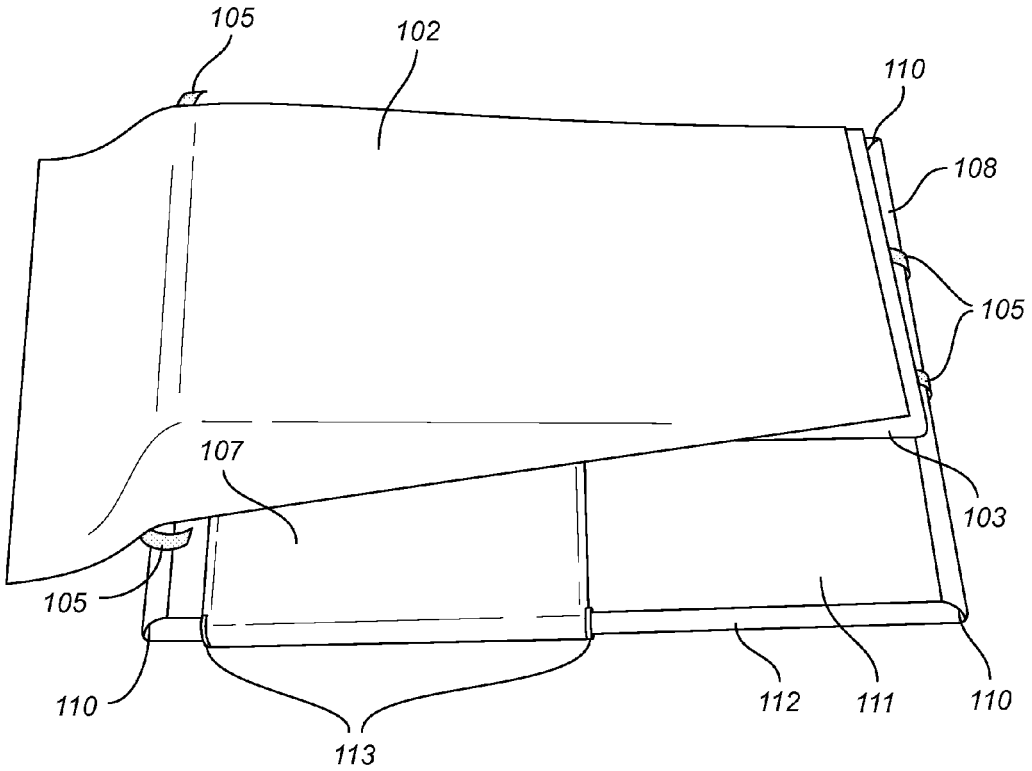
FIG. 8 is an illustration of an aerial view of the mirror box 100 when the long rectangular panel 103 and the square or rectangular sliding panel 107 are each folded inside along each line of separation between the rectangular mirror panel for flat transport when it is in the collapsed configuration for storing or transporting. In this depiction the flap is conveniently connected to the long rectangular panel 103 with a VELCRO® strip 104.

The long rectangular panel 103 may comprise a bend 114 in the long rectangular panel frame to enable the long rectangular panel 103 to lie about flush against the square or rectangular sliding panel 107 when folded into the collapsed version for storage or portability, as depicted with FIG. 8. In this aspect, the frame dimensions and materials may be designed and fabricated to allow for the mirror box to fold down for flat transport and storage.

In some embodiments, the two perpendicular ends of the sliding side and each shorter side of the long rectangular side further comprise at least one fastener and each at the perimeter for connecting each the short frame rail of the support arm when the sliding side is positioned at either end of the long rectangular mirror side along the line of separation between the sliding side and the rectangular mirror unit, wherein the connected support arm, a perpendicular end of the sliding side, a shorter side of the long rectangular side and a short side of the rectangular mirror unit provide a supported mirror box.

In some embodiments, the support arm is about the same height of the first and second short sides of a mirror frame; positioned between the long rectangular panel and the sliding panel to keep them from folding toward the mirror panel.

In some embodiments, the support arm comprises a middle frame rail that is about the same height of the first and second short sides of a mirror frame and is connected to two short frame rails that are shorter in length than the first and second short sides of a long rectangular panel frame, positioned between the long rectangular panel and the sliding panel to keep them from folding toward the mirror panel.

In some embodiments, the fasteners used to connect the support arm of a first and second non-sliding sides of the square or rectangular sliding panel and the first and second short sides of the long rectangular panel, further comprise at least one fastener at the perimeter of each of the sides for connecting the support arm when the sliding side is positioned at either end of the long rectangular mirror panel to provide a supported mirror box, wherein the at least one fastener may comprise one or more VELCRO® loops 105, and wherein each VELCRO® loop 105 may comprise a strip of sanitizable cover material on the backside of the of VELCRO® loop 105.

These loops made of sanitized material and VELCRO® were created and placed on each short side of the long rectangular side 103 and the perpendicular ends of the sliding side 107 to connect the support arm 200. The support arm 200 may be fabricated from metal (i.e., steel, aluminum, titanium, etc.), plastic, carbon fiber or combinations thereof and is designed to support one end of the mirror box when used in a long sit position. In some embodiments, the support arm 200 may not be required when the mirror box therapy system is used in the short sit position.

Figure 2:
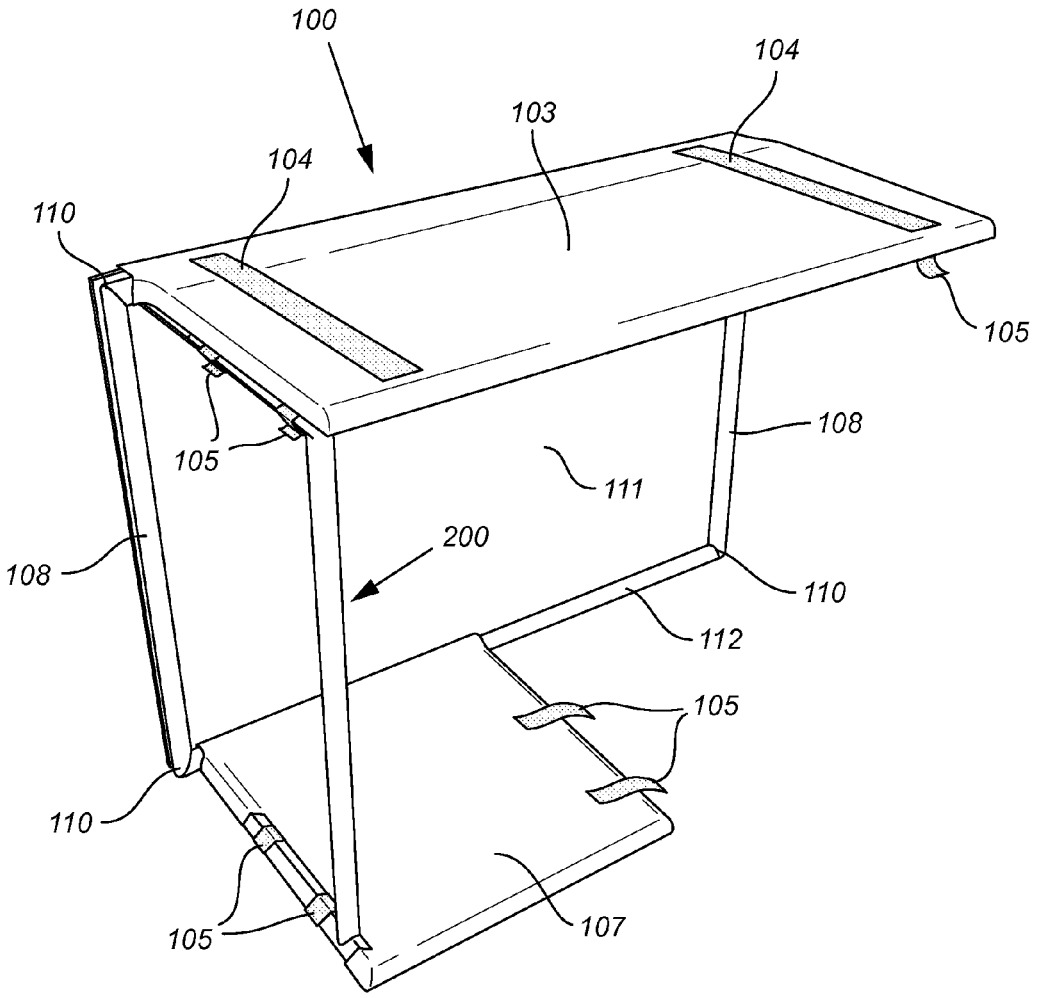
FIG. 2 is an illustration of a side view of the mirror box 100 assembled without the flap 102 and depicting the support arm 200 and the length difference between the long rectangular panel 103 and the sliding slide 107.
Figure 3:
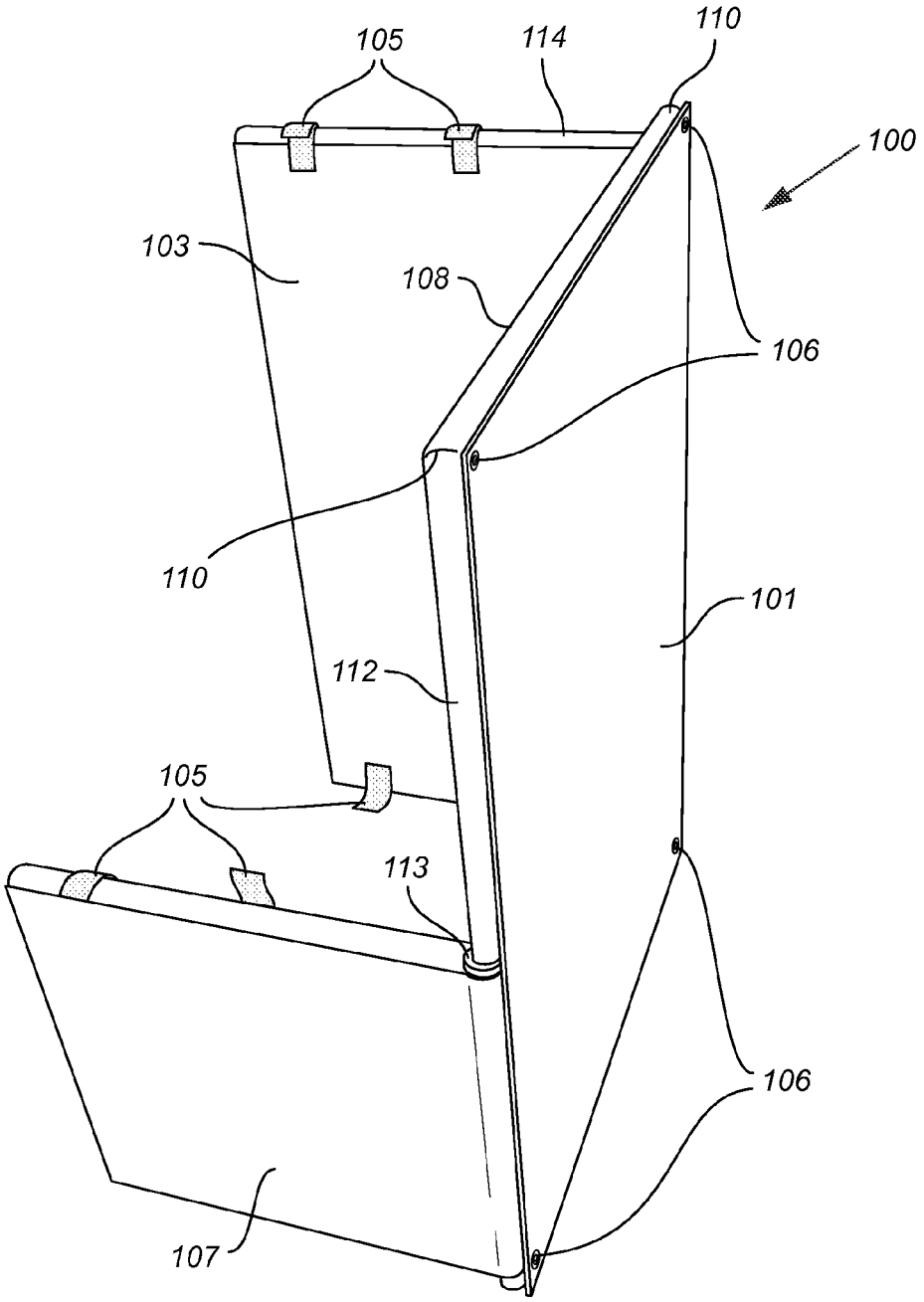
FIG. 3 is an illustration of a side view of the mirror box 100 in the short sit position without the flap.
Figure 7:
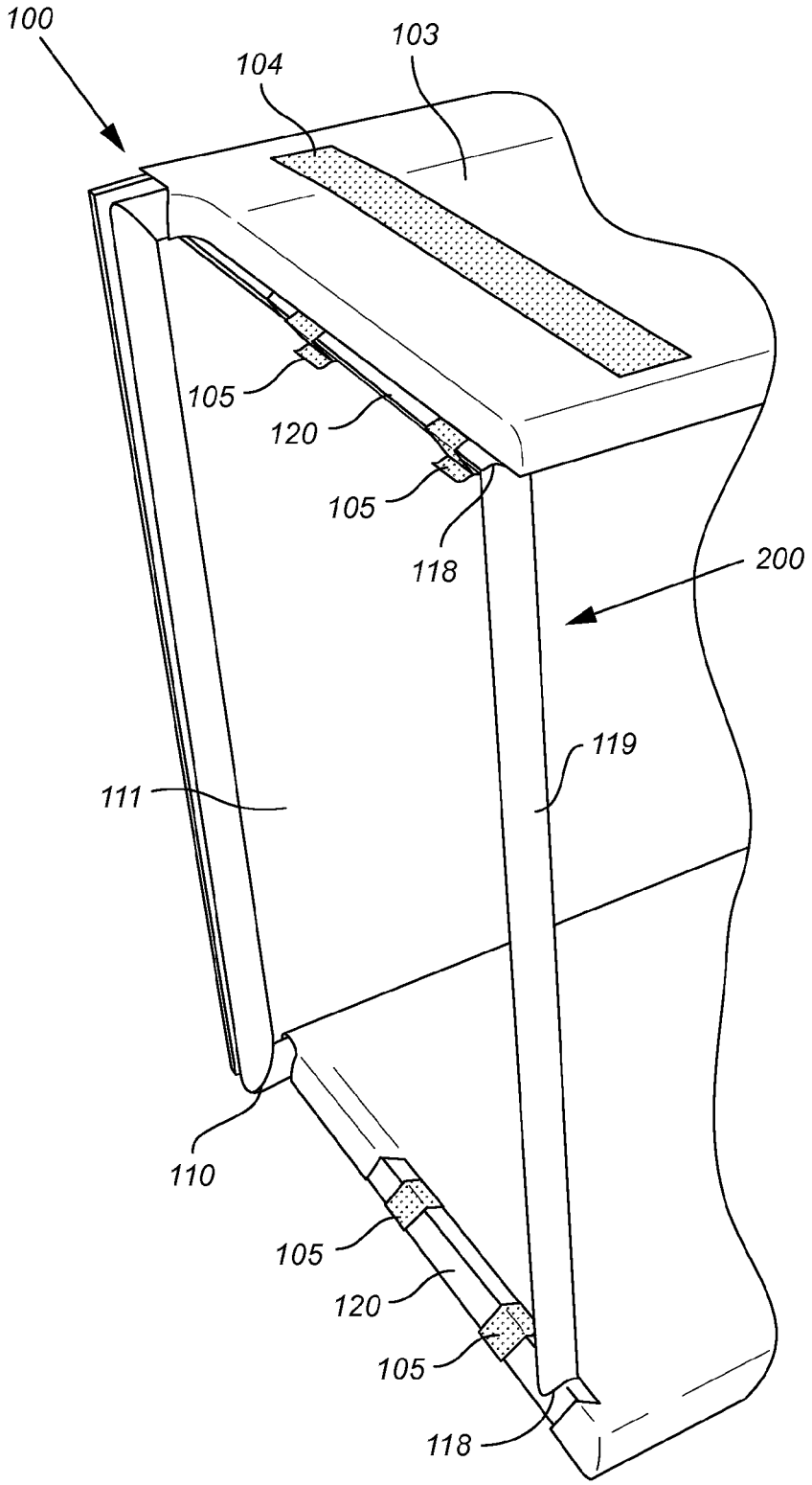
FIG. 7 is an illustration of an exploded view of the support arm 200 and its depiction while connected to the frame of a first or second short side of the long rectangular panel 103.

As depicted with FIGS. 2, 3, 5, 6, and 7, the loops 105 may be used to connect the support arm 200 when the invention is used in the long sit position, as pictured in FIGS. 1, 2, and 7. The loops 105 are made of the same vinyl material as the adjacent edge coverings, in order to have the same ease of sanitizing property, but they could be made of any material that is easily cleaned in between clients. These loops 105 were attached to the long rectangular panel 103 and the perpendicular ends of the sliding panel 107 edges by sewing 117, but may be attached through other means such as snaps, VELCRO® or glue sufficient secure the loops in place. In some embodiments, the loops use VELCRO® to attach to the inside 115 and 116, in order to provide a secure hold for the support arm 200, as depicted with FIG. 7, as depicted for use in the long sit position as pictured in FIG. 2. Loops 105 were also attached to the edges of the flap 102 in order to secure the flap 102 to the frame 112, when used in the long sit position as pictured in FIG. 4. In addition to the loops 105 other suitable releasable fasteners can be used on the sliding panel and long rectangular panel to secure a support arm, non-exclusively including snaps, clips, sheaths, hook and loop fasteners, and the like. These releasable fasteners can be positioned on any suitable part of the long rectangular panel and/or the sliding panel.

The support arm 200 is constructed of a strong metal material, but can be constructed of hard plastic or any other suitable material. For example, a single long pylon 119 connected to two shorter pieces of metal 120 that are of sufficient shape to lie flush with the outside of the perimeter edges of 103 and 107. The composite pieces of the arm may be connected through welding 118 at roughly a 90 degree angle (or any suitable angle 80-100 degrees), but could be connected through any suitable mechanism. The support arm 200 is used primarily to support the mirror box's rectangular shape when used in the long sit position, as depicted in FIGS. 1 and 2. In other embodiments not shown, the support arm can be a hinged arm permanently coupled to either the long rectangular panel or the sliding panel, or a straight arm, without the side arms 120. For embodiments directed to a straight support arm without the side arms 120, the support arm could be positioned within holes, sheaths, or grommets within the long rectangular panel and the sliding panel.

Figure 4:
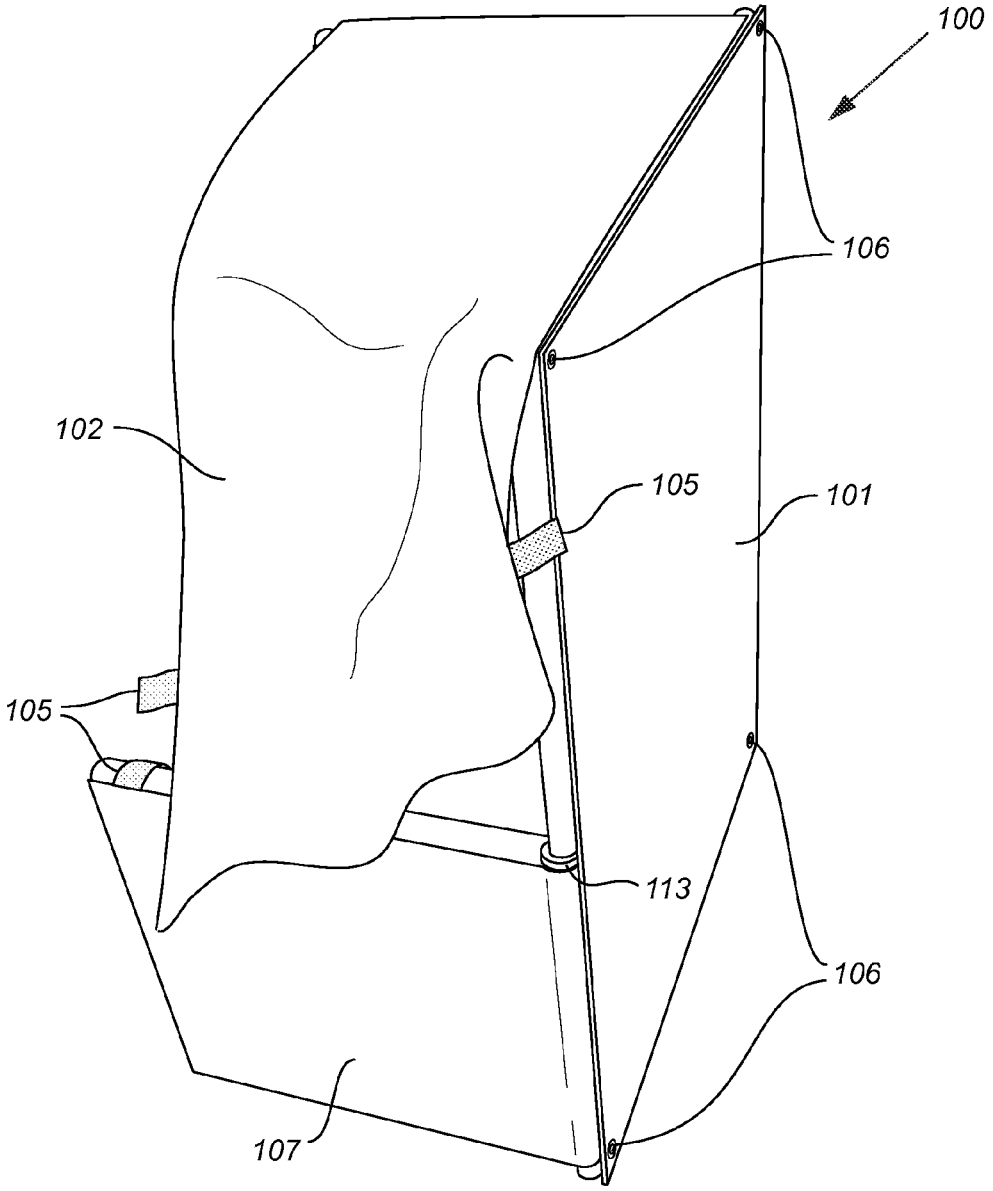
FIG. 4 is an illustration of the working end view of the mirror box 100 in the short sit position with the flap 102.
Figure 5:
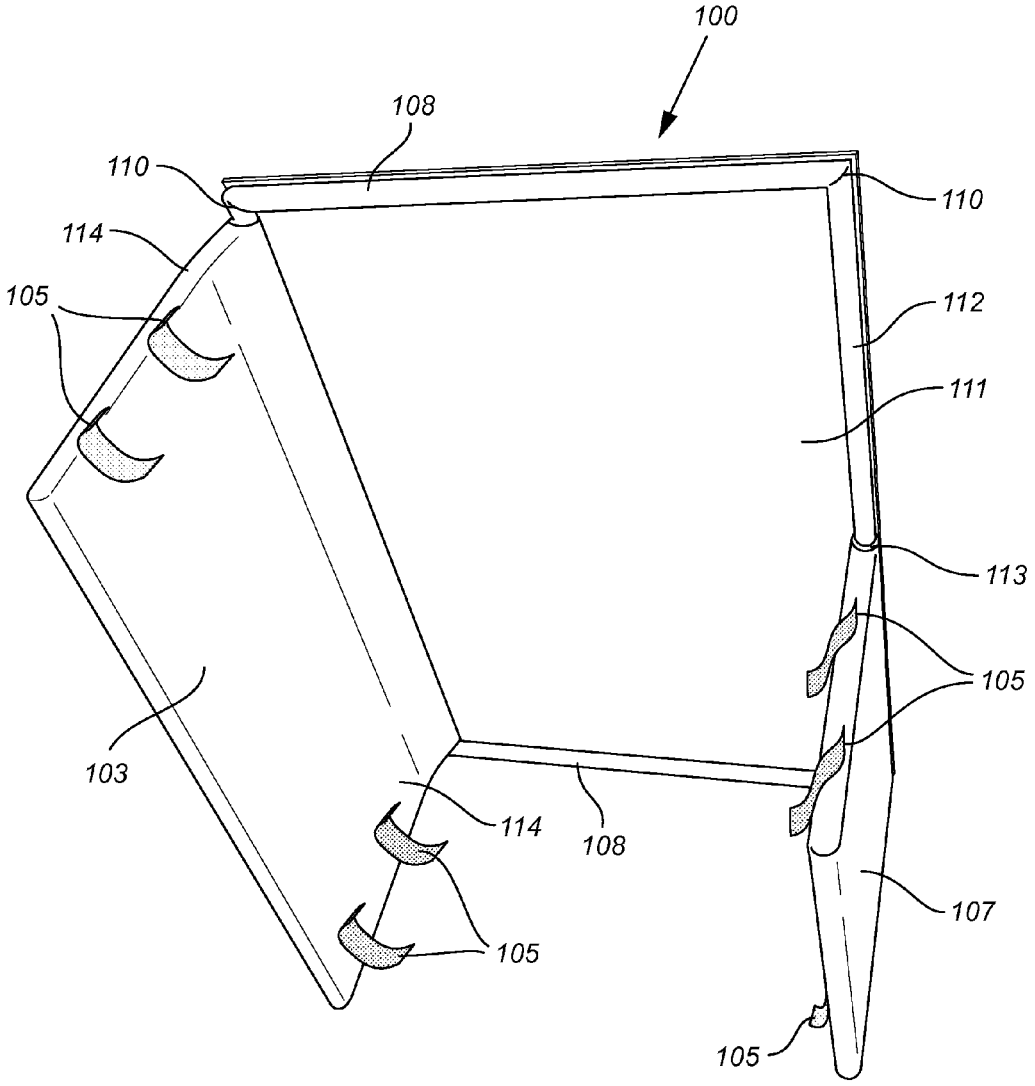
FIG. 5 is an illustration of a side view of the mirror box 100 without the flap 102, depicting the long rectangular panel 103 and the square or rectangular sliding panel 107 provides a space for an impaired limb (i.e., leg) and a partition to be used in conjunction with the flap 102 covering in order to block the patient's view of the impaired limb.
Figure 6:
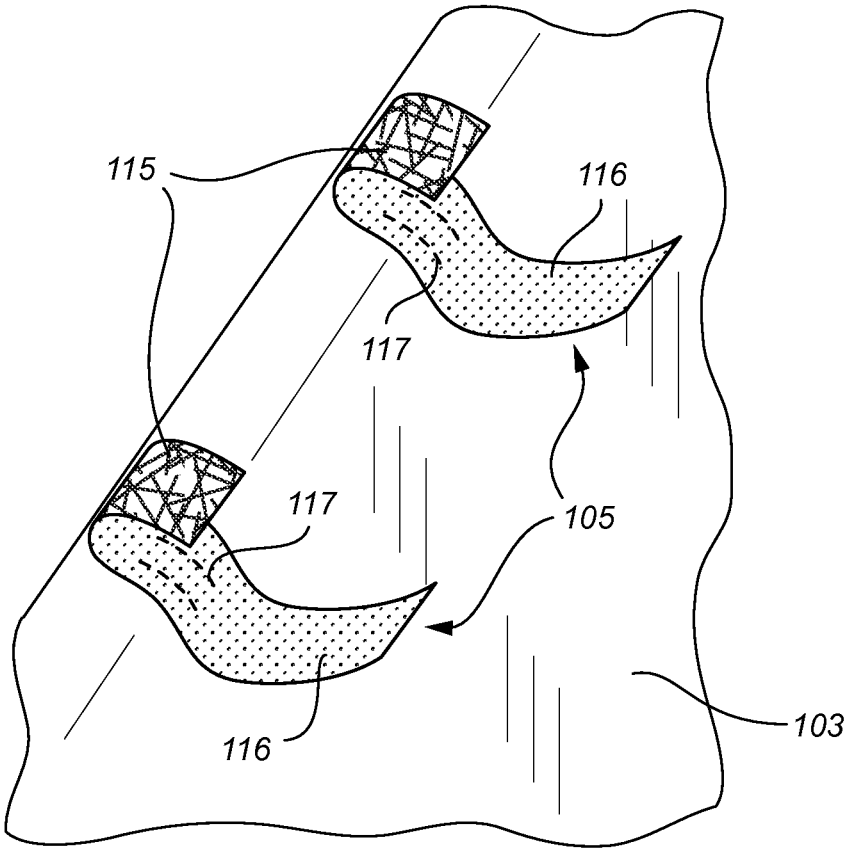
FIG. 6 is an illustration of an exploded view of the loops 105 that connect the support arm to the frame of a first or second short side of the long rectangular panel 103.

The flap 102 is composed of vinyl material, but again could be composed of any suitable material able to be wiped down between clients. The flap 102 provides to conceal the impaired leg that is placed inside of the mirror box, whether it is in long sit position FIG. 1 or short sit position FIG. 4. The flap 102 is connected to the a first or second short side of the long rectangular panel 103 through use of VELCRO® strips 104, as depicted in FIG. 2. The flap 102 also may have loops 105 attached to it through sewing or some other suitable means attach and detach the flap from frame 112, when used in the short sit position, as seen in FIG. 4. The VELCRO® strips 104 on the short side of the long rectangular panel 103 may be placed on the edge or other suitable spots.

In some embodiments, the first and second short sides of the long rectangular panel, further comprise VELCRO® strips 104 connected to the edge (or other suitable positions) and running parallel of a first and second short side of the long rectangular panel, and wherein the flap further comprises one or more VELCRO® strips 104 or one or more VELCRO® loops 105 for connecting the flap to provide a covering over the working end of the mirror box. Other suitable releasable fasteners can be used with all embodiments herein for VELCRO® loops, including other hook and loop fasteners, snaps, buttons, clips, and the like. In addition the attachment points between the mirror box 100 and the flap 102 can be positioned any suitable spot.

The sliding panel 107 and the long rectangular panel 103 may be covered in a vinyl material or another suitable material that is durable and able to withstand repeated sanitization procedures (i.e., wiping with dilute bleach solution) between patients, and attached to the frames with a fastener such as one or more screws, bolts or glue, etc., or sewn to the frame with the use of pockets with zippers or any other suitable method. Another function of the sanitizable material covering the adjacent ends is to create a visual barrier when the client has his or her impaired leg inside of the structure. The cover material may be vinyl, oil cloth, imitation leather such as NAUGAHYDE®, or some other appropriate material, which is then attached around each of the two ends of the frame. The smaller end of the frame was attached to the middle end in a way that it could move or shuttle from one side of the reflective surface to the other side.

In some embodiments, the mirror box further comprises a rectangular mirror panel frame, wherein the frame comprises a plurality of structural frame rails and is connected with a at least one fastener to a back side of the mirror, wherein the frame rails are fabricated from steel, aluminum, titanium, plastic, or combinations thereof, and wherein the frame rails are tubular or solid and are welded or fastened to each adjacent frame rail.

In some embodiments, the long rectangular panel, further comprises a plurality of structural frame rails and is covered with a long rectangular panel cover thereby providing a sanitizable surface, wherein the frame rails are fabricated from steel, aluminum, titanium, plastic, or combinations thereof, and wherein the frame rails are tubular or solid and are welded or fastened to each adjacent frame rail.

In some embodiments, the square or rectangular sliding panel, further comprises a plurality of structural frame rails positioned about the perimeter and is covered with a square or rectangular sliding panel cover thereby providing a sanitizable surface, wherein the frame rails are fabricated from steel, aluminum, titanium, plastic, or combinations thereof, and wherein the frame rails are tubular or solid and are welded or fastened to each adjacent frame rail.

In another embodiment, disclosed herein is a method of treatment with the use of a mirror box, comprising: a) identifying a patient with one unhealthy limb and a healthy limb; b) providing the mirror box of claim 1 to the patient; c) positioning patient's unhealthy limb into the internal space of the mirror box and their healthy limb outside the mirror box adjacent to the mirror such that the patient can view the reflection of their healthy limb; d) attaching the flap on the mirror box to prevent the patient from viewing their unhealthy limb within the internal space; and e) providing at least one exercise to the patient involving the movement of their healthy limb.

In some embodiments, disclosed herein is a method of treatment with the use of a mirror box, comprising: the use of a left mirror box therapy system formed when the sliding side is positioned with the support arm connected to a first non-sliding side and a first short side of the long rectangular panel; and wherein the left mirror box can independently accommodate the patient in a long sit position with an outer surface of the long rectangular panel facing up or a short sit position with an outer surface of the long rectangular panel facing forward by rotating the mirror box about its axis.

In some embodiments, disclosed herein is a method of treatment with the use of a mirror box, comprising: the use of a right mirror box therapy system formed when the sliding side is positioned with the support arm connected to a second non-sliding side and a second short side of the long rectangular panel, wherein the right mirror box and the left mirror box can independently accommodate the patient in a long sit position with an outer surface of the long rectangular panel facing up or a short sit position with an outer surface of the long rectangular panel facing forward by rotating the mirror box about its axis.

In some embodiments, disclosed herein is a method of treatment with the use of a mirror box, comprising: the use of a working end that comprises an open end of the mirror box with the mirror facing outwardly left or outwardly right and an outer surface of the long rectangular panel facing forward for the patient in a short sit position with a limb positioned inside the mirror box and the flap connected and draped over the same limb, thereby blocking the patient's line of sight to the same limb from the working end.

In some embodiments, disclosed herein is a method of treatment with the use of a mirror box, comprising: the use of a working end that comprises an open end of the mirror box with the mirror facing outwardly left or outwardly right and an outer surface of the long rectangular panel facing upward for the patient in a long sit position with a limb positioned inside the mirror box and the flap connected and draped over the same limb, thereby blocking the patient's line of sight to the same limb from the working end.

In some embodiments, the mirror box is useful in reducing or eliminating phantom limb pain in lower extremity amputees or other persons with chronic unilateral leg pain.

In some embodiments, the mirror box is useful in improving paralyzed or partially paralyzed muscles in a unilateral stroke patient or person with paralysis or partial paralysis in only one leg.

In some embodiments, the method of treatment comprises the use of the at least one exercise are repeatedly performed and provide an indication of brain plasticity.

In some embodiments, the mirror box is used in a long sit position, where the knees are straight in front of a person, and alternatively in a short sit position, where the knees are bent and feet are resting at a level below the hip.

In some embodiments, the mirror box is lightweight and sized adequately in its dimensions for a person of typical height.

In some embodiments, disclosed herein is a method of treatment with the use of a mirror box, comprising: the use of a rectangular mirror panel frame, wherein the frame comprises a plurality of structural frame rails and is connected with a at least one fastener to a back side of the mirror, wherein the frame rails are fabricated from steel, aluminum, titanium, plastic, or combinations thereof, and wherein the frame rails are tubular or solid and are welded or fastened to each adjacent frame rail.

In some embodiments, disclosed herein is a method of treatment with the use of a mirror box, comprising: the use of the long rectangular panel, further comprises a plurality of structural frame rails and is covered with a long rectangular panel cover thereby providing a sanitizable surface, wherein the frame rails are fabricated from steel, aluminum, titanium, plastic, or combinations thereof, and wherein the frame rails are tubular or solid and are welded or fastened to each adjacent frame rail.

In some embodiments, disclosed herein is a method of treatment with the use of a mirror box, comprising: the use of the square or rectangular sliding panel, further comprises a plurality of structural frame rails positioned about the perimeter and is covered with a square or rectangular sliding panel cover thereby providing a sanitizable surface, wherein the frame rails are fabricated from steel, aluminum, titanium, plastic, or combinations thereof, and wherein the frame rails are tubular or solid and are welded or fastened to each adjacent frame rail.

In some embodiments, disclosed herein is a method of treatment with the use of a mirror box, comprising: the use of a mirror panel cover that is connected to the back side of the mirror, thereby providing a sanitizable surface.

In some embodiments, disclosed herein is a method of treatment with the use of a mirror box, comprising: the use of a support arm about the same height of the first and second short sides of a mirror frame; positioned between the long rectangular panel and the sliding panel to keep them from folding toward the mirror panel.

In some embodiments, disclosed herein is a method of treatment with the use of a mirror box, comprising: the use of a support arm that comprises a middle frame rail that is about the same height of the first and second short sides of a mirror frame and is connected to two short frame rails that are shorter in length than the first and second short sides of a long rectangular panel frame, positioned between the long rectangular panel and the sliding panel to keep them from folding toward the mirror panel.

In some embodiments, disclosed herein is a method of treatment with the use of a mirror box, comprising: the use of a first and second non-sliding sides of the square or rectangular sliding panel and the first and second short sides of the long rectangular panel, further comprise at least one fastener at the perimeter of each of the sides for connecting the support arm when the sliding side is positioned at either end of the long rectangular mirror panel to provide a supported mirror box, wherein the at least one fastener may comprise one or more VELCRO® loops, and wherein each VELCRO® loop may comprise a strip of sanitizable cover material on the backside of the of VELCRO® loop.

In some embodiments, disclosed herein is a method of treatment with the use of a mirror box, comprising: the use of the first and second short sides of the long rectangular panel, further comprise VELCRO® strips connected to the edge and running parallel of a first and second short side of the long rectangular panel, and wherein the flap further comprises one or more VELCRO® strips or one or more VELCRO® loops for connecting the flap to provide a covering over the working end of the mirror box.

The presently disclosed systems and methods are not to be limited in scope by the specific embodiments described herein, which are intended as single illustrations of individual aspects of the presently disclosed systems and methods, and functionally equivalent systems and methods and components are within the scope of the presently disclosed systems and methods. Indeed, various modifications of the presently disclosed systems and methods, in addition to those shown and described herein will become apparent to those skilled in the art from the foregoing description and accompanying drawings. Such modifications are intended to fall within the scope of the appended claims.

What is claimed is:

1. A mirror box, comprising:

a) three interconnected panels defining a C-shaped internal space configured to hold a patient's unhealthy limb, comprising:

i. a rectangular mirror panel having first and second long and short sides;

wherein the mirror faces away from the internal space;

ii. an opaque long rectangular panel, having first and second long and short sides, wherein the first long side is perpendicularly hinged to the first long side of a mirror frame such that the long rectangular panel can fold toward the mirror panel to be substantially parallel with it;

iii. a square or rectangular sliding panel, comprising a sliding side that is 25-75% less than a length of the first and second long sides of the long rectangular panel and is perpendicularly hinged to and configured to slide along the second long side of the mirror frame; such that the sliding panel can fold toward the mirror panel to be substantially parallel with it; and b) an opaque flap that can be releasably attached to the mirror box to block the patient from viewing their unhealthy limb when positioned within the internal space of the mirror box.

2. The mirror box of claim 1, further comprising a support arm substantially the same height of the first and second short sides of a mirror frame; positioned between the long rectangular panel and the sliding panel to keep them from folding toward the mirror panel.

3. The mirror box of claim 2, wherein the support arm is releasably attachable to the mirror box and comprises a middle frame rail that is about the same height of the first and second short sides of a mirror panel and is connected to two short frame rails that are shorter in length than the first and second short sides of a long rectangular panel frame, positioned between the long rectangular panel and the sliding panel to keep them from folding toward the mirror panel.

4. The mirror box of claim 3, wherein the sliding panel and the long rectangular panel have releasable fasteners to secure the support arm.

5. The mirror box of claim 4, wherein both a first and second non-sliding side of the sliding panel and each of the first and second short sides of the long rectangular panel comprise a releasable fastener for coupling the two short frame rails of the support arm.

6. The mirror box of claim 5, wherein the releasable fasteners are hook and loop straps.

7. The mirror box of claim 1, wherein the opaque flap is longer than the first and second short sides of the mirror panel.

8. The mirror box of claim 7, wherein the opaque flap is configured to be releasably attachable to an outer surface of the long rectangular panel.

9. The mirror box of claim 8, wherein the opaque flap is configured to be releasably attachable near the first short side of the long rectangular panel and the second short side of the long rectangular panel.

10. A method of treatment with the use of the mirror box of claim 1, comprising:

a) identifying a patient with one unhealthy limb and a healthy limb;

b) providing the mirror box of claim 1 to the patient;

c) positioning patient's unhealthy limb into the internal space of the mirror box and their healthy limb outside the mirror box adjacent to the mirror such that the patient can view the reflection of their healthy limb;

d) attaching the opaque flap on the mirror box to prevent the patient from viewing their unhealthy limb within the internal space; and e) providing at least one exercise to the patient involving the movement of their healthy limb while their unhealthy limb is within the internal space of the mirror box.

11. The method of claim 10, further comprising having the patient in a long sit position such that they are sitting or lying on a floor or mat and their healthy limb is a leg fully extended; positioning the mirror box into a long sit configuration by placing the second long side of the mirror panel on a floor or a mat, such that the mirror panel is perpendicular to the floor or mat, and an outer surface of the sliding panel is flat on the floor or mat and the long rectangular panel is parallel to the sliding panel above the unhealthy limb positioned within the internal space of the mirror box.

12. The method of claim 10, further comprising having the patient sit in an elevated sitting position such that their healthy limb is a leg that is bent about 90 degrees; positioning the mirror box into a short sit configuration by placing the first short side of the mirror panel on a floor or a mat such that the mirror panel is perpendicular to the floor or mat, positioning the sliding panel downward such that it is perpendicular to the floor or mat and the first short side of the long rectangular panel on the floor or mat such that the long rectangular panel is perpendicular to the floor or mat such that the long rectangular panel is parallel to the sliding panel.

13. The method of claim 10, further comprising a support arm substantially the same height of the first and second short sides of a mirror frame; positioned between the long rectangular panel and the sliding panel to keep them from folding toward the mirror panel.

14. The method of claim 13, wherein the support arm is releasably attachable to the mirror box and comprises a middle frame rail that is about the same height of the first and second short sides of a mirror panel and is connected to two short frame rails that are shorter in length than the first and second short sides of a long rectangular panel frame, positioned between the long rectangular panel and the sliding panel to keep them from folding toward the mirror panel.

15. The method of claim 14, wherein the sliding panel and the long rectangular panel have releasable fasteners to secure the support arm.

16. The method of claim 15, wherein both a first and second non-sliding side of the sliding panel and each of the first and second short sides of the long rectangular panel comprise a releasable fastener for coupling the two short frame rails of the support arm.

17. The method of claim 16, wherein the releasable fasteners are hook and loop straps.

18. The method of claim 10, wherein the opaque flap is longer than the first and second short sides of the mirror panel.

19. The method of claim 18, wherein the opaque flap is configured to be releasably attachable to an outer surface of the long rectangular panel.

20. The method of claim 19, wherein the opaque flap is configured to be releasably attachable near the first short side of the long rectangular panel and the second short side of the long rectangular panel.

* * * * *